US005341519A

United States Patent [19]

Cusenza

[11] Patent Number: 5,341,519

[45] Date of Patent: Aug. 30, 1994

[54] SANITARY FLEXIBLE TOILET SEAT HANDLE

[76] Inventor: Vincent P. Cusenza, 22400 Alger, St. Clair Shores, Mich. 48080

[21] Appl. No.: 184,647

[22] Filed: Jan. 21, 1994

[51] Int. Cl.[5] ..... A47K 13/10

[52] U.S. Cl. ..... 4/246.1; 16/110 R

[58] Field of Search ..... 4/246.1; 16/110 R, 114 R, 16/122

[56] References Cited

U.S. PATENT DOCUMENTS

| | | | |
|---|---|---|---|
| 2,236,576 | 4/1941 | Loebner | 4/246.1 |
| 2,318,518 | 5/1943 | Opperer | 4/246.1 |
| 2,852,114 | 9/1958 | Heit | 16/114 R |
| 3,145,050 | 8/1964 | Edwards | 16/110 R |
| 3,717,884 | 2/1973 | Mantooth | 4/246.1 X |
| 3,783,455 | 1/1974 | Vanderbrook | 4/246.1 X |
| 4,129,907 | 12/1978 | Vaughan et al. | 4/246.1 |
| 4,951,324 | 8/1990 | Lirette | 4/246.1 |
| 5,065,460 | 11/1991 | Currin | 4/246.1 X |

*Primary Examiner*—Robert M. Fetsuga

*Attorney, Agent, or Firm*—Remy J. VanOphem

[57] ABSTRACT

A sanitary flexible lifting handle for lifting the seat of a toilet. The seat has a bore extending therethrough for retaining the sanitary flexible lifting handle. The handle includes a first peg portion located in the bore in the seat, a spring connected to the first peg portion and extending from the bore of the seat, a second peg portion connected to the other end of the spring and a flexible sheath encasing the first and second peg portions and the spring which is press-fit in the bore of the seat. Rubber washer ends are connected to the exposed faces of the peg portions at the ends of the sheath and assist in flexibly retaining the lifting handle in the bore of the seat.

8 Claims, 1 Drawing Sheet

SANITARY FLEXIBLE TOILET SEAT HANDLE

BACKGROUND OF THE INVENTION

1. FIELD OF THE INVENTION

The present invention relates to an apparatus for the sanitary lifting of a toilet seat. More particularly, the present invention relates to a flexible handle which is connected to the toilet seat in such a way that the toilet seat may be lifted without requiring a person to come in contact with the toilet seat itself and is also constructed in such a way as to provide a more durable lift handle which even if subjected to abuse will not break off and therefore provide long term life.

2. DESCRIPTION OF THE PRIOR ART

Prior to the present invention, lifting handles were either attached to the toilet seat directly using screws or the like, or the lifting handle was molded in a single piece as part of the toilet seat. Additionally, lifting handles were typically made of a solid construction. For example, U.S. Pat. No. 1,999,555, to Adams, discloses a sanitary seat lift for a water closet bowl seat in which a solid handle is attached to a toilet seat by screws or other means. Similarly, U.S. Pat. Nos. 2,318,518, to Opperer; 2,236,576, to Loebner; 3,717,884, to Mantooth; 3,783,455, to Vanderbrook; 4,129,907, to Vaughn et al.; and 5,065,460, to Curtin, all disclose and teach that the lifting handle is directly secured to the toilet seat through the use of a screw or other similar mounting device. None of these prior art references, except for Currin, disclose the use of a flexible handle for lifting the toilet seat. However, with respect to the flexible handle of Currin, Currin teaches that the end of the flexible handle is secured to the side of the toilet seat through the use of a screw which when subjected to abuse could easily be broken away from the toilet seat by placing direct pressure on the base 19 with a force generated by a foot.

Thus, according to the prior art, the best, if not universal, means for securing the handle to the seat is to directly attach the lifting handle by use of a screw or the like, to the side or bottom of the toilet seat. Additionally, according to the prior art it is preferable to provide a lifting handle of solid construction. This can be a problem if a user stands on or kicks the handle in order to lift or drop the toilet seat. Additionally, these types of screwed on lifting handles are prone to creating stress fractures within the toilet seat and therefore tend to tear out from the seat. This is especially true if too large a force is applied. In this case either the rigid handle will be broken or the threaded handle will be torn from the toilet seat thereby destroying the toilet seat. Furthermore, the prior art handles do not operate in a fashion to provide a flexible lifting handle which passes through the toilet seat in order to provide an efficient and uniform lifting force while providing a flexible handle which resists breaking and is not screwed directly into the toilet seat.

In general, the prior art also teaches lifting handles which have a single point of contact between the handle and the toilet seat which concentrates the forces in the handle at the single point of contact. This tends to prematurely weaken the handle and the strength of the connection between the handle and seat thereby reducing the useful life of the handle and the toilet seat if abused, as indicated heretofore.

Thus, a sanitary flexible lifting handle for a toilet seat which is capable of operating without the above disadvantages is lacking in the prior art. In particular, the prior art does not disclose or suggest a sanitary lifting handle which is capable of efficiently and evenly transferring the lifting force to lift the toilet seat. Thus, there is a need for a sanitary flexible lifting handle for lifting and setting down the seat of a toilet, wherein the lifting handle is of a construction and is connected to the toilet seat in such a way as to resist breaking of the handle and to resist breaking the toilet seat when an excessive force is applied to the handle as in the case of an abuse by a user.

SUMMARY OF THE INVENTION

The present invention relates to an improved sanitary flexible lifting handle for raising and lowering the seat of a toilet. The present invention provides a flexible handle constructed of first and second peg portions having a spring or other biasing means located therebetween and covered by a protective sheath. The toilet seat has a bore drilled therethrough for receiving one end of the handle. The diameter of the bore is preferably chosen such that the handle is snugly retained in the bore. First and second rubber bumper ends are then attached to the first and second peg portions located in the ends of the handle such that the bumper ends prevent the handle from being removed from the toilet seat yet maintain its flexibility.

It is therefore an object of the present invention to provide a sanitary flexible lifting handle for raising and lowering the seat on a toilet which avoids the disadvantages of the prior art.

It is a further object of the present invention to provide a sanitary flexible lifting handle which provides for a more efficient and uniform lifting of the toilet seat.

It is still a further object of the present invention to provide a sanitary flexible lifting handle which is secured to the toilet seat in such a way that the handle cannot be easily broken off or damaged if an excessive force is applied to the lifting handle.

It is yet another object of the present invention to provide a sanitary flexible lifting handle which can be easily and inexpensively assembled.

It is still yet another object of the present invention to provide a sanitary flexible lifting handle which achieves all of the stated objectives and can be either installed as part of the original manufacturing process or can be adapted to previously manufactured and installed toilet seats while still providing all of the stated advantages of the present invention.

Other objects and advantages of the present invention will become more apparent from the following detailed description of the invention with reference being made to the accompanying drawings.

DETAILED DESCRIPTION OF THE PREFERRED EMBODIMENT

Figure 1:
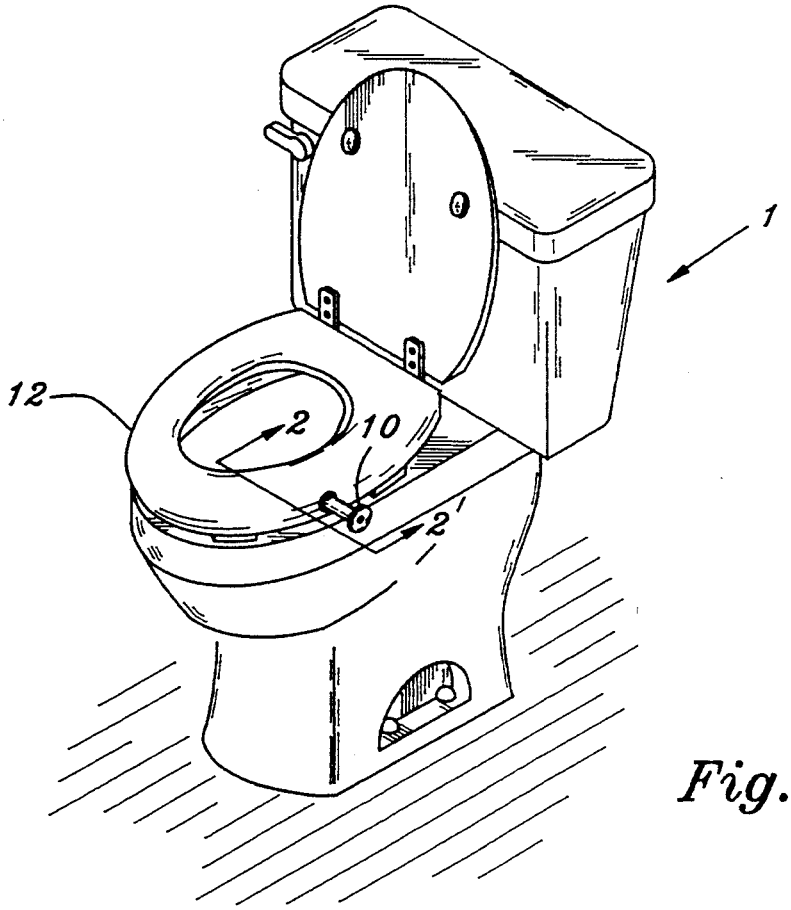
FIG. 1 is a perspective view of a toilet including the present invention installed on the toilet seat.
Figure 2:
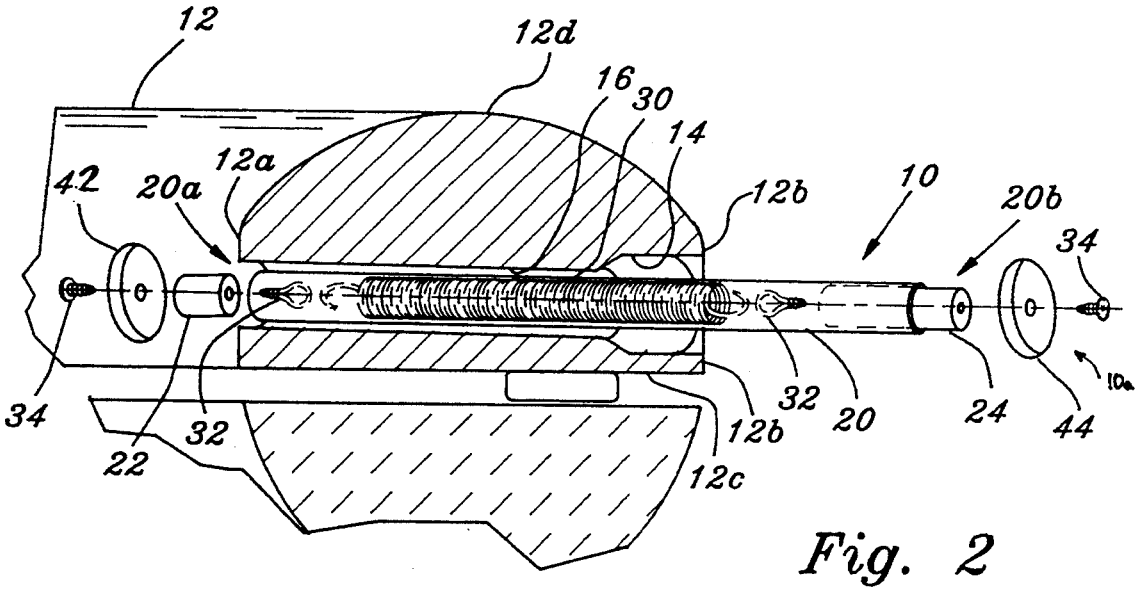
FIG. 2 is an exploded sectional view of the present invention installed on a toilet seat taken along lines 2—2 of FIG. 1.

Referring to the drawings, FIG. 1 is a perspective view of a toilet 1 including the sanitary flexible handle, generally designated 10, connected to a toilet seat 12. FIG. 2 illustrates the toilet seat 12 having an inner side 12*a*, an outer side 12*b*, a lower side 12*c* and an upper side 12*d*. The handle 10 is located in a pair of coaxially extending bores or holes located in the seat 12.

A first bore 14 for receiving the handle 10 is formed in the seat and opens along the outer side 12*b* and extends across a portion of the seat 12. A second bore 16 for receiving the handle 10 is also formed in the seat and opens along the inner side 12*a* and also extends across the section of the seat 12 to communicate with the first bore 14. In the figures, the bores 14 and 16 are shown as having different diameters, however it is possible that they could have the same size diameter. The bores 14 and 16 may be formed in the seat 12 by any known process including molding the bore directly in the seat as the seat is molded or both bores may be drilled into the seat after the seat is molded. It is also possible to have a contoured passage through the seat instead of the bore. That is, the bores or passages 14 and 16 can be made to have any convenient cross section and to flare open near the inner and outer sides 12*a* and 12*b*. The advantage of having the handle 10 connect to the toilet seat through the bores 14 and 16 becomes readily apparent.

As shown in FIG. 2, the handle 10 connects to the seat through mounting the various components in the bores 14 and 16.

The handle 10 has an outer covering or sheath 20 which serves to provide a housing for and protect the interior parts of the handle 10. The sheath 20 is a tube, preferably made of a flexible plastic or rubber. The sheath has a first end 20*a* and an opposite second end 20*b*. In the figures, the sheath 20 is shown as extending completely across the seat 12, however, the sheath 20 does not have to completely cross through the bores 14 and 16 of the seat 12. The sheath 20 may have a width such that it will only penetrate the first bore 14, but will not extend into the second the bore 16. In this alternative, the sheath 20 still extends from the seat 12 to be engaged by a user. The sheath 20 has located therein a first peg portion 22 and a second peg portion 24. The first peg portion 22 is located in the first end 20*a* of the sheath 20. The second peg portion 24 is located in the second end 20*b* of the sheath 20 and serves as a solid portion to provide rigidity to the sheath 20 when a user grasps the handle 10 around an end 10*a* thereof. The second peg portion reinforces the handle sufficiently while still providing for a flexible attachment so that the handle 10 cannot be easily broken off from the seat 12.

A spring member 30 or other flexible means for providing the handle with a predetermined amount of flexibility is disposed between the first and second peg portions 22 and 24. Preferably, a coil spring having good strength and flexibility is used. One end of the spring 30 is connected to the first peg portion 22 and its other end is connected to the second peg portion 24. Eye hooks 32 are shown in the drawings for connecting the spring 30 to the first and second peg portions 22 and 24, however, any appropriate means can be used to make the connection.

When the spring 30 and the first and second peg portions 22 and 24 are assembled and inserted in the sheath 20, end pieces 42 and 44 are attached to the exposed faces of the first and second peg portions 22 and 24, respectively. The end pieces 42 and 44 are preferably disk-shaped and made of a soft, pliable substance such as rubber or the like but may be of any appropriate shape or size which covers the end of the sheath 20. The end pieces 42 and 44 serve to protect the ends of the handle and to maintain the sheath containing the spring member and peg portions in position relative to the toilet seat sides. The end pieces 42 and 44 can be attached to the respective first and second peg portions 22 and 24 using known attachment devices such as a screw 34. Regardless of the manner in which the ends are attached, for obvious reasons care must be taken to ensure that sharp edges or corners are not exposed once the ends are secured in place. While it is possible to permanently attach the ends 42 and 44 to the first and second peg portions 22 and 24, it is preferable to use a removable attachment means so that if service or replacement of the handle is necessary a minimum of effort will be needed to remove the handle 10 from the seat 12.

In the preferred embodiment, when a force is applied to the end 10*a* of the handle 10 to lift the seat 12, the force is transferred through the handle 10 to the seat 12 along the entire length of the handle 10 which contacts the seat 12. By having the handle 10 located in the first and second bores 14 and 16, the lifting force is spread over a larger surface area thereby providing a more even and efficient lifting force to the seat 12.

Assembly of the handle 10 and installation in the seat 12 can be accomplished in any manner as long as the above mentioned concerns are heeded during the installation. First, the ends of the spring 30 are attached to the first and second peg portions 22 and 24 using the eye hooks 32. Next, the first and second peg portions 22 and 24 and the attached spring 30 are inserted in the sheath 20. The first end 20*a* of the sheath is inserted into the first and second bores 14 and 16 in the seat 12 such that the first end 20*a* of the sheath 20 is approximately flush with the inner side 12*a* of the toilet seat 12 and so that the second end 20*b* of the sheath 20 extends from the toilet seat and can be easily engaged by a user. Once the sheath 20 is inserted in the seat 12, the ends 42 and 44 are attached to their respective first and second peg portions 22 and 24 using screws 34, so that the handle 10 is now permanently retained to the seat 12.

With the seat 12 having the sanitary flexible lifting handle 10 in the down position, a user can easily grasp the handle 10 on the outer side 12*b* of the seat 12 and lift the seat 12 to the raised position without having to contact any portion of the seat 12 or toilet 1. Once finished, the user can then lower the seat 12 using the sanitary flexible lifting handle 10, again without contacting the seat 12 or the toilet 1.

Additionally, the handle of the present invention is more durable than known devices and not as likely to break by improper use of the device. With a handle according to the present invention, there is a potential for a person who uses their foot to lift the seat or to step on the handle to utilize the toilet seat without the risk of breaking the handle. In known prior art devices wherein the handle is bolted or screwed directly to the toilet seat and has a single point of contact therewith, when the handle is improperly used or an excessive force is exerted thereon, there is a chance that the handle will be snapped off or that the toilet seat will fracture. However, because the handle of the present invention is flexibly retained in the bore passing through the toilet seat and a force exerted thereon is more evenly distributed, there is less possibility of damage to the toilet seat or handle.

While the invention has been described in terms of a preferred embodiment, it is apparent that other forms could be adopted by one skilled in the art. Accordingly, the scope of the invention is to be limited only by the following claims.

What is claimed is:

1. A sanitary flexible lifting handle and toilet seat combination, said toilet seat having an upper surface, a lower surface, an outer side surface and an inner side surface, said combination comprising:

a first peg portion having a first end and a second end;

a spring having a first end and a second end, said first end of said spring connected to said first end of said first peg portion;

a second peg portion having a first end and a second end, said second end of said second peg portion connected to said second end of said spring;

a sheath having a first end and a second end, said sheath covering said first peg portion, and at least a portion of said spring; and said toilet seat having a first bore located in said outer side surface and extending in a direction toward said inner side surface of said toilet seat, said toilet seat having a second bore located in said inner side surface and extending in a direction toward said outer side surface of said toilet seat such that said first and second bores are axially aligned, said sheath being located in said first and second bores of said toilet seat and extending in a direction away from said toilet seat.

2. The combination of claim 1 wherein said first bore has a predetermined diameter and said second bore has a different size predetermined diameter.

3. The combination of claim 2 wherein said predetermined diameter of said first bore of said toilet seat is larger than said predetermined diameter of said second bore of said toilet seat.

4. The combination of claim 1 further comprising:

means for securing said flexible lifting handle within said first and second bores of said toilet seat, said securing means being attached to said flexible lifting handle.

5. The combination of claim 4 wherein said securing means comprises:

a first rubber end connected to said second end of said first peg portion and adjacent said inner side surface of said toilet seat.

6. The combination of claim 5 further comprising:

a second rubber end connected to said first end of said second peg portion.

7. The combination of claim 1 wherein said sheath is made of plastic.

8. The combination of claim 1 wherein said sheath extends across said spring and said second peg portion.

* * * * *